US011208290B2

(12) United States Patent
Amai et al.

(10) Patent No.: US 11,208,290 B2
(45) Date of Patent: Dec. 28, 2021

(54) POST-PROCESSING APPARATUS, IMAGE FORMING APPARATUS, AND POST-PROCESSING METHOD

(71) Applicant: KYOCERA Document Solutions Inc., Osaka (JP)

(72) Inventors: Ryo Amai, Osaka (JP); Kazuhisa Iwamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/105,596

(22) Filed: Nov. 26, 2020

(65) Prior Publication Data

US 2021/0155442 A1 May 27, 2021

(30) Foreign Application Priority Data

Nov. 26, 2019 (JP) ..... JP2019-213023

(51) Int. Cl.

| | |
|---|---|
| ***B65H 43/04*** | (2006.01) |
| ***B31F 5/00*** | (2006.01) |
| ***B65H 31/36*** | (2006.01) |
| ***B65H 37/04*** | (2006.01) |

(52) U.S. Cl.

CPC ..... *B65H 43/04* (2013.01); *B31F 5/001* (2013.01); *B65H 31/36* (2013.01); *B65H 37/04* (2013.01)

(58) Field of Classification Search

CPC ..... B65H 31/34; B65H 31/36; B65H 37/04; B65H 43/04; B65H 2511/52; B31F 5/001; B42C 1/12; G03G 2215/00822; G03G 2215/00827

USPC ..... 270/58.08, 58.12, 58.17

See application file for complete search history.

(56) References Cited

U.S. PATENT DOCUMENTS

| | | | | |
|---|---|---|---|---|
| 6,145,825 | A * | 11/2000 | Kunihiro | B42C 1/12 270/58.09 |
| 6,634,641 | B2 * | 10/2003 | Yamakawa | B65H 31/36 270/58.01 |
| 7,431,683 | B2 * | 10/2008 | Takemoto | B65H 31/34 270/52.17 |
| 9,016,681 | B2 * | 4/2015 | Mizubata | B65H 29/145 270/58.11 |

(Continued)

FOREIGN PATENT DOCUMENTS

JP 2001-316026 A 11/2001

*Primary Examiner* — Leslie A Nicholson, III

(74) *Attorney, Agent, or Firm* — Hawaii Patent Services; Nathaniel K. Fedde; Kenton N. Fedde

(57) ABSTRACT

Provided are a post-processing apparatus, an image forming apparatus, and a post-processing method capable of avoiding the occurrence of a malfunction due to a failure to discharge a sheet bundle after a binding process. A plurality of sheets is loaded on a stack tray. A staple unit binds the plurality of sheets. A discharge roller discharges the sheet bundle bound by the staple unit from the stack tray. Each time a sheet is conveyed to the stack tray, an aligning unit moves between a first position in contact with the sheet loaded on the stack tray and a second position separating from the sheet. A detection processing unit detects a failure of discharging the sheet bundle by the discharging roller. A stop processing unit can stop the operation of the aligning unit when the discharge failure is detected by the detection processing unit.

9 Claims, 6 Drawing Sheets

(56) References Cited

U.S. PATENT DOCUMENTS

| | | | | |
|---|---|---|---|---|
| 9,415,966 | B2 * | 8/2016 | Nishi | B65H 31/02 |
| 10,351,383 | B2 * | 7/2019 | Saito | B65H 31/36 |

* cited by examiner

POST-PROCESSING APPARATUS, IMAGE FORMING APPARATUS, AND POST-PROCESSING METHOD

INCORPORATION BY REFERENCE

This application is based on and claims the benefit of priority from Japanese Patent Application No. 2019-213023 filed on Nov. 26, 2019, the contents of which are hereby incorporated by reference.

BACKGROUND

The present disclosure relates to a post-processing apparatus, an image forming apparatus, and a post-processing method capable of avoiding the occurrence of malfunction due to a failure to discharge a bundle of sheets after a binding process.

An image forming apparatus capable of performing a binding process for binding a plurality of printed sheets is known. For example, in an image forming apparatus of a typical technology, an image of a document is printed on each of a plurality of sheets continuously conveyed, and the plurality of sheets are loaded on a sheet loading unit. In the sheet loading unit, the posture of the sheet is adjusted by the aligning unit each time the sheet is loaded. When a preset number of sheets are loaded on the sheet loading unit, a preset number of sheets are bound by the binding processing unit. Then, the sheet bundle bound by the binding processing unit is discharged from the sheet loading unit by a discharging unit.

SUMMARY

A post-processing apparatus according to one aspect of the present disclosure includes a sheet loading unit, a binding processing unit, a discharging unit, an aligning unit, a detection processing unit, and a stop processing unit. In the sheet loading unit, a plurality of sheets transported from a sheet feed unit is loaded. The binding processing unit binds the plurality of sheets loaded on the sheet loading unit. The discharge unit discharges a sheet bundle bound by the binding processing unit from the sheet loading unit. The aligning unit performs an aligning operation that moves on the sheet loading unit between a first position, which contacts a sheet loaded on the sheet loading unit, and a second position, which separates from the sheet, each time being conveyed sheets to the sheet loading unit. The detection processing unit detects a discharge failure of the sheet bundle by the discharge unit. The stop processing unit is capable of stopping the aligning operation of the aligning unit when the discharge failure is detected by the detection processing unit.

The post-processing method according to another aspect of the present disclosure is performed by the post-processing apparatus. The post-processing method includes a sheet loading process, a binding processing process, a discharging process, an aligning process, a detection processing process, and a stop processing process. The loading process performs loading a plurality of sheets transported from the sheet feed unit on a sheet loading unit. The binding process performs binding the plurality of sheets loaded on the sheet loading unit. The discharging process discharges a sheet bundle bound by the binding process from the sheet loading unit. The aligning process adjusts posture of the sheet bundle by moving between a first position contacting a sheet loaded on the sheet loading unit and a second position separating from the sheet each time being conveyed one or a plurality of sheets to the sheet loading unit. The detection process detects a discharge failure of the sheet bundle by the discharging process. The stop process stops the aligning process when the discharge failure is detected.

DETAILED DESCRIPTION

Hereinafter, an embodiment of the present disclosure is described with reference to the accompanying drawings. The following embodiment is an example that embody the present disclosure and does not limit the technical scope of the present disclosure.

[Structure of Image Forming Apparatus 10]

Figure 1:
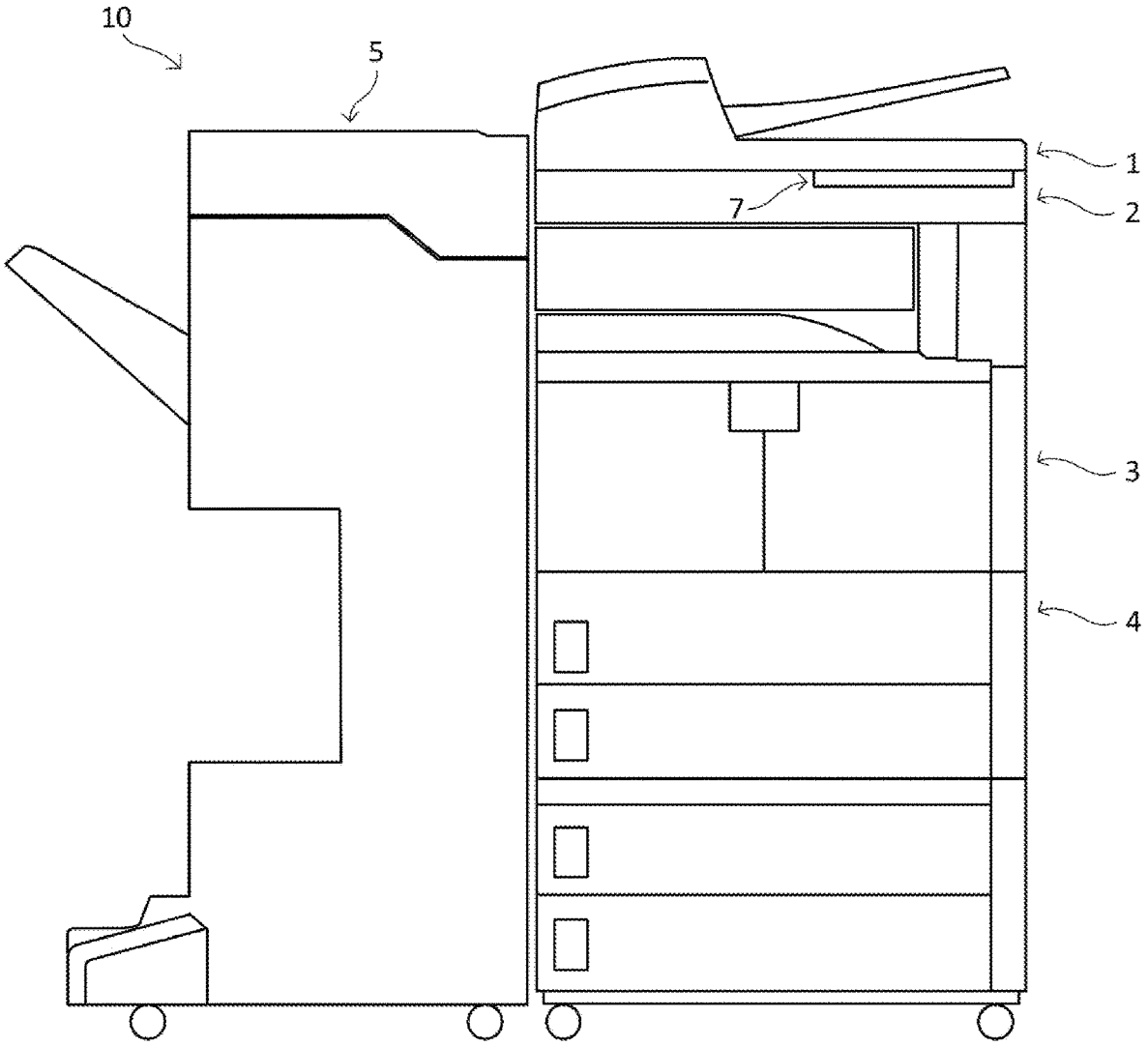
FIG. 1 is a diagram showing an external configuration of an image forming apparatus according to an embodiment of the present disclosure.
Figure 2:
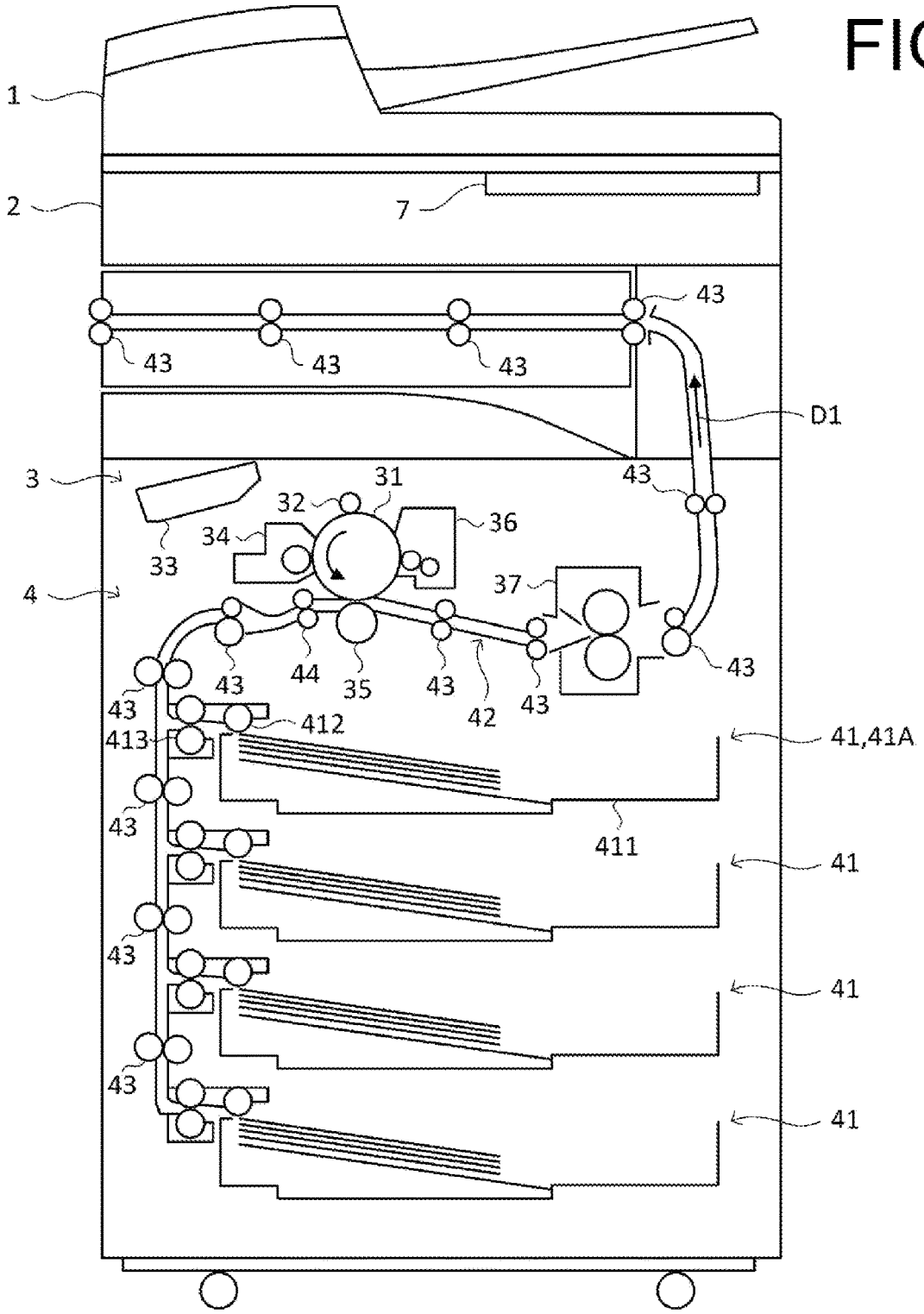
FIG. 2 is a diagram showing a partial configuration of an image forming apparatus according to the embodiment of the present disclosure.
Figure 3:
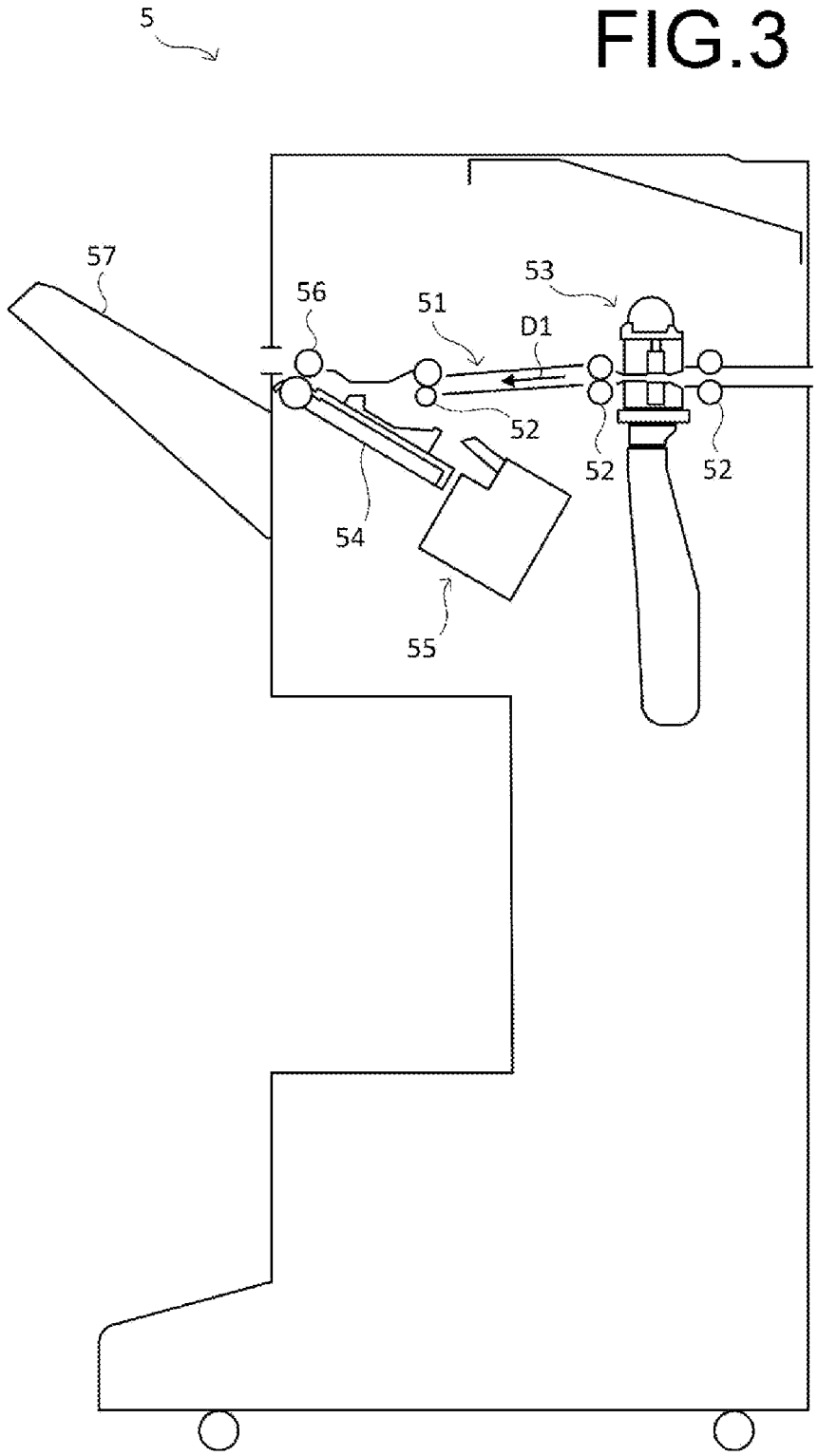
FIG. 3 is a diagram showing a configuration of a post-processing apparatus for the image forming apparatus according to the embodiment of the present disclosure.
Figure 4:
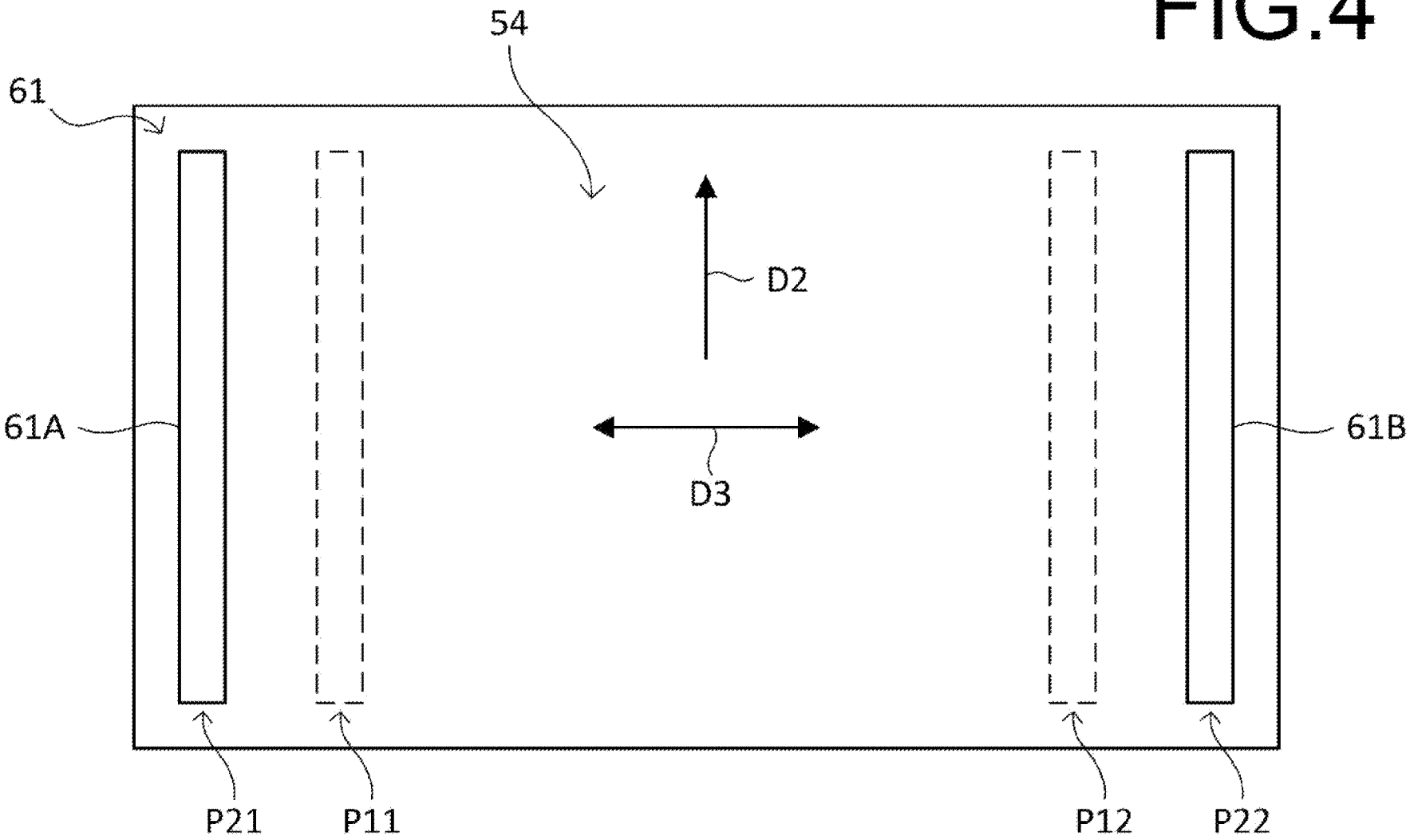
FIG. 4 is a diagram showing a configuration of a seat loading unit of the image forming apparatus according to the embodiment of the present disclosure.

At first, with reference to FIGS. 1 to 5, the configuration of the image forming apparatus 10 according to the embodiment of the present disclosure is described. Here, FIG. 2 is a cross-sectional view showing the configuration of the image forming unit 3 and the sheet conveying unit 4. Further, FIG. 3 is a cross-sectional view showing the configuration of the post-processing apparatus 5. Further, FIG. 4 is a plan view showing the configuration of the stack tray 54.

The image forming apparatus 10 is a multifunctional peripheral having a scanning function for reading image data from a document, a printing function for forming an image based on the image data, and a plurality of functions such as a facsimile function, a copying function, and the like. In addition, the image forming apparatus 10 may be a printer apparatus, a facsimile apparatus, a copier, or the like.

Figure 5:
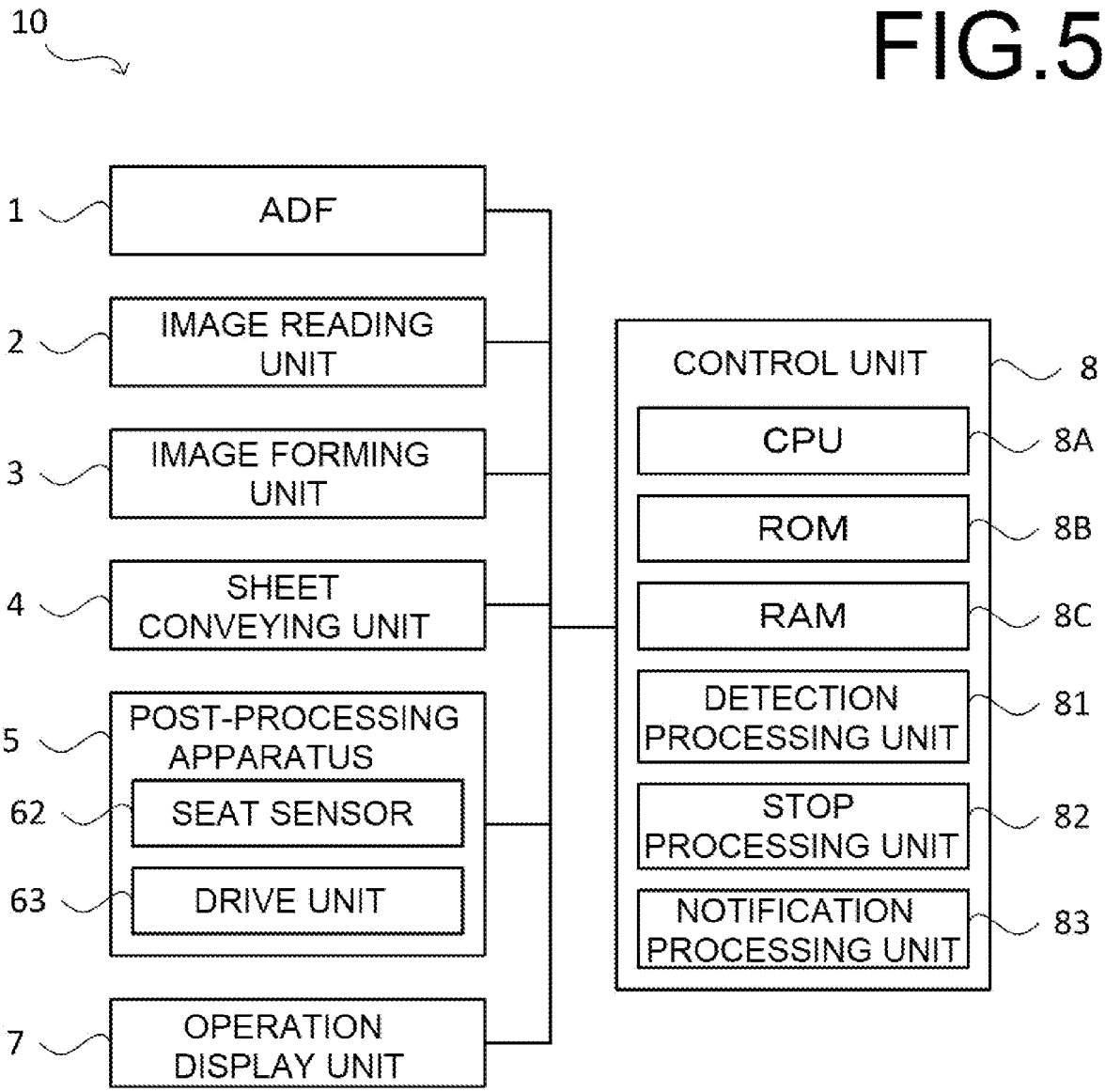
FIG. 5 is a block diagram showing a system configuration of the image forming apparatus according to the embodiment of the present disclosure.

As shown in FIGS. 1 and 5, the image forming apparatus 10 includes an ADF (Automatic Document Feeder) 1, an image reading unit 2, an image forming unit 3, a sheet conveying unit 4, a post-processing apparatus 5, an operation display unit 7, and a control unit 8.

The ADF 1 includes a document setting unit, a plurality of transport rollers, a document retainer, and a sheet ejection unit, and it transports a document that is to be read by the image reading unit 2. The image reading unit 2 includes a platen, a light source, a plurality of mirrors, an optical lens, and a CCD, and it can read image data from the document.

The image forming unit 3 can perform an image forming process (printing process) for forming an image by an electrophotographic method based on image data read by the image reading unit 2. Further, the image forming unit 3 can also perform the printing process based on image data input from an information processing apparatus such as an external personal computer, or the like. As shown in FIG. 2, the image forming unit 3 includes a photoconductor drum 31, a charging device 32, an optical scanning device 33, a developing device 34, a transfer roller 35, a cleaning device 36, and a fixing unit 37.

The sheet transport unit 4 transports the sheet to the post-processing apparatus 5 via the image forming position by the image forming unit 3. As shown in FIG. 2, the sheet transport unit 4 includes four sheet feed units 41, a first transport path 42, a plurality of transport rollers 43, and a resist roller 44.

Each of the four sheet feed units 41 includes a sheet feed cassette 411, a pickup roller 412, and a sheet feed roller 413, respectively. On the sheet cassette 411, a sheet used for forming an image is placed. For example, the sheets placed on the sheet cassette 411 include a sheet, a coated sheet, a postcard, an envelope, a transparency (OHP sheet), and the like. The pickup roller 412 conveys the sheet located at the top position among the plurality of sheets placed on the sheet feed cassette 411 to the sheet feed roller 413. The sheet feed roller 413 conveys the sheet conveyed by the pickup roller 412 to the first transfer path 42.

The first transport path 42 is a moving passage for sheets connecting each of the sheet feed cassettes 411 and the post-processing apparatus 5. For example, the first transport path 42 is formed by a pair of guide members provided inside the housing of the image forming apparatus 10. The first transport path 42 is provided with a plurality of transport rollers 43 and a resist roller 44 used for transporting sheets. In the sheet transfer unit 4, the sheet is conveyed by the plurality of transfer rollers 43 and the resist roller 44 in the transfer direction D1 as shown in FIG. 2.

In the image forming unit 3, an image is formed on the sheet transported from the sheet conveying unit 4 by the following procedure.

Firstly, the charging device 32 uniformly charges the surface of the photoconductor drum 31 to a specific potential. Next, the light based on the image data on the surface of the photosensitive drum 31 is irradiated by the optical scanning device 33. As a result, an electrostatic latent image corresponding to the image data is formed on the surface of the photoconductor drum 31.

Then, the electrostatic latent image formed on the surface of the photoconductor drum 31 is developed (visualized) as a toner image by the developing device 34. The toner image developed by the developing device 34 is conveyed to the transfer position (image forming position) by the transfer roller 35 by the photoconductor drum 31 rotating in the direction of the arrow shown in FIG. 2. In addition, the developing device 34 is supplied with toner from a toner container that can be attached to and detached from the image forming unit 3.

On the other hand, the sheet transport unit 4 transports the sheet to the image forming position in parallel with the image forming operation by the image forming unit 3. For example, a case where the sheet feed cassette 411 of the sheet feed unit 41A (as refer to FIG. 2) is set as the sheet feed source among the four sheet feed units 41 is described. In this case, a plurality of sheets mounted on the sheet cassette 411 are lifted to a contact position with the pickup roller 412 by a lift plate provided at the bottom of the sheet cassette 411. The pickup roller 412 takes out the sheet located at the highest position among the plurality of sheets lifted by the lift plate. The sheet taken out by the pickup roller 412 is conveyed to the first transfer path 42 by the sheet feed roller 413. The sheet conveyed to the first transfer path 42 by the sheet feed roller 413 is conveyed to the resist roller 44 by the transfer roller 43.

The resist roller 44 sends the sheet to the image forming position at the timing of conveying the toner image by the photoconductor drum 31 to the image forming position. For example, in the first transport path 42, a sensor for detecting the passage of the sheet is provided on the upstream side in the transport direction D1 with respect to the arrangement position of the resist roller 44. The control unit 8 sets the sheet delivery timing by the resist roller 44 that matches the transfer timing based on the detection timing of the sheet passage by the sensor. Then, the resist roller 44 sends the sheet to the image forming position based on the sending timing set by the control unit 8. As a result, the toner image transferred at the transfer timing is transferred by the transfer roller 35 on the surface of the sheet transmitted to the image forming position at the transfer timing.

In addition, the toner remaining on the surface of the photoconductor drum 31 after the toner image is transferred by the transfer roller 35 is removed by the cleaning device 36. For example, in the cleaning device 36, the toner remaining on the surface of the photoconductor drum 31 is removed by the blade-shaped cleaning member. Then, the toner removed by the cleaning member is conveyed to the toner storage container by a conveying screw and is collected.

The sheet on which the toner image is transferred at the image forming position is conveyed to the fixing unit 37 by the conveying roller 43. At the fixing unit 37, the toner image transferred to the sheet is heated and compressed by the heating roller and the pressure roller. As a result, the toner image is melted and fixed on the sheet. The sheet on which the toner image is fixed by the fixing unit 37 is conveyed to the post-processing apparatus 5 by the conveying roller 43.

The post-processing apparatus 5 performs post-processing such as forming-hole processing (punching processing) and stapling processing on the sheet after image formation conveyed from the sheet conveying unit 4. As shown in FIGS. 3 to 5, the post-processing apparatus 5 are provided with a second transport path 51, a plurality of transport rollers 52, a punch unit 53, a stack tray 54 (an example of the sheet loading unit of the present disclosure), and a staple unit 55 (an example of the binding processing unit of the present disclosure), a discharge roller 56 (an example of the discharge unit of the present disclosure), a discharge tray 57, a pair of aligning units 61, a sheet sensor 62, and a drive unit 63.

The second transport path 51 is a moving passage for the sheet connecting the first transport path 42 and the discharge tray 57. The second transport path 51 is provided with a plurality of transport rollers 52 used for transporting sheets. In the post-processing apparatus 5, the sheet is conveyed by the plurality of transfer rollers 52 in the transfer direction D1 as shown in FIG. 4.

The punch unit 53 is provided in the second transport path 51, and performs a punch processing of punching a punch hole in the sheet transported through the second transport path 51. The stack tray 54 is provided on the downstream side in the transport direction D1 with respect to the punch unit 53 in the second transport path 51. On the stack tray 54, a plurality of sheets conveyed from the sheet cassette 411 are loaded. The staple unit 55 performs a staple processing of binding the plurality of sheets with staples to the plurality of sheets loaded on the stack tray 54. The discharge roller 56 conveys a sheet bundle subjected to the staple processing by the staple unit 55 in the discharge direction D2 (as refer to FIG. 4), and it discharges the sheet bundle from the stack tray 54 to the discharge tray 57.

The pair of aligning units 61 adjust the posture of the sheets loaded on the stack tray 54.

Specifically, the aligning unit 61A, which is one of the pair of aligning units 61, is a plate-shaped member provided on the upper surface of the stack tray 54. The aligning unit 61A is movably provided in the stack tray 54 in the width direction D3 (as refer to FIG. 4) orthogonal to the discharge direction D2. Further, the aligning unit 61B, which is the other of the pair of aligning units 61, is a plate-shaped member provided on the upper surface of the stack tray 54 so as to face the aligning unit 61A. The aligning unit 61B is provided on the stack tray 54 so as to be movable in the width direction D3 in conjunction with the aligning unit 61A. For example, the aligning unit 61A and the aligning unit 61B are provided in a rack and pinion provided inside the stack tray 54 so as to be inter-lockable in a direction close to or separated from each other in the width direction D3.

The aligning unit 61A receives the driving force supplied from the driving unit 63, and it moves between a contact position P11 (an example of the first position in the present disclosure) and a separation position P21 (an example of the second position in the present disclosure) as shown in FIG. 4. The contact position P11 is a position where the aligning unit 61A comes into contact with the sheet loaded on the stack tray 54. The contact position P11 changes according to the size of the sheet loaded on the stack tray 54. In FIG. 4, the aligning unit 61A moved to the contact position P11 is indicated by a broken line. The separation position P21 is a position where the aligning unit 61A is separated from the sheet loaded on the stack tray 54.

The aligning unit 61B moves between the contact position P12 and the separation position P22 as shown in FIG. 4 in conjunction with the operation of the aligning unit 61A. The contact position P12 is a position where the aligning unit 61B contacts the sheet loaded on the stack tray 54. The contact position P12 changes according to the size of the sheet loaded on the stack tray 54. In FIG. 4, the aligning unit 61B moved to the contact position P12 is indicated by a broken line. The separation position P22 is a position where the aligning unit 61B is separated from the sheet loaded on the stack tray 54.

The aligning unit 61A moves between the contact position P11 and the separation position P21 each time one sheet is conveyed to the stack tray 54. Further, the aligning unit 61B moves between the contact position P12 and the separation position P22 in conjunction with the aligning unit 61A.

Specifically, the aligning unit 61A moves from the separation position P21 to the contact position P11 when the sheet is conveyed to the stack tray 54. Further, the aligning unit 61B moves from the separation position P22 to the contact position P12 in conjunction with the aligning unit 61A. As a result, the positions of the sheets loaded on the stack tray 54 in the width direction D3 are adjusted. After that, the aligning unit 61A moves from the contact position P11 to the separation position P21. Further, the aligning unit 61B moves from the contact position P12 to the separation position P22 in conjunction with the aligning unit 61A. The pair of aligning units 61 performs the above aligning process each time one sheet is conveyed to the stack tray 54. In addition, the aligning process may be executed every time a specific number of sheets are conveyed to the stack tray 54.

In addition, the post-processing apparatus 5 may include only one of the aligning unit 61A and the aligning unit 61B. Further, the post-processing apparatus 5 may provide an aligning unit capable of adjusting the position of the discharge direction D2 on the sheet loaded on the stack tray 54.

The sheet sensor 62 can detect the discharge of the sheet from the stack tray 54. For example, the seat sensor 62 is a reflective optical sensor provided on a seat loading surface of the stack tray 54.

The drive unit 63 moves the pair of aligning units 61 by receiving the supply of electric current. For example, the drive unit 63 is a motor.

The operation display unit 7 includes a display unit such as a liquid crystal display, or the like, that displays various information in response to a control instruction from the control unit 8, an operation unit such as an operation key, a touch panel, or the like, that inputs various information to the control unit 8 in response to a user operation.

The control unit 8 includes control devices such as a CPU 8A, a ROM 8B, and a RAM 8C. The CPU 8A is a processor that executes various kinds of arithmetic processes. The ROM 8B is a non-volatile storage device in which information such as a control program for causing the CPU 8A to execute various processes is stored in advance, or the like. The RAM 8C is a volatile storage device used as a temporary storage memory (work area) for various processes executed by the CPU 8A. In the control unit 8, various control programs stored in advance in the ROM 8B are executed by the CPU 8A. As a result, the image forming apparatus 10 is collectively controlled by the control unit 8. In addition, the control unit 8 may be configured as an electronic circuit such as an integrated circuit (ASIC), or it may be a control unit provided separately from the main control unit that collectively controls the image forming apparatus 10.

The control unit 8 can execute a specific printing process of printing a plurality of copies of a document having a plurality of pages, binding each printed matter in units of printed copies with staples, and outputting the printed matter. Specifically, when the execution instruction of the specific print process is input, the control unit 8 controls the sheet transport unit 4 to sequentially transport the sheets from the sheet cassette 411 set as the sheet feed source. Further, the control unit 8 controls the image forming unit 3 to print the page image of the document on each sheet transported by the sheet transport unit 4. Further, the control unit 8 controls the post-processing apparatus 5 to cause the pair of aligning units 61 to perform the aligning process each time a sheet is conveyed to the stack tray 54. Then, each time the stack tray 54 is loaded with a plurality of sheets corresponding to printed matter in units of copies, the control unit 8 causes the staple unit 55 to perform the staple processing, and it discharges the sheet bundle after the staple processing to the discharge tray 57.

By the way, the discharge of the sheet bundle after the staple processing by the discharge roller 56 may fail, and the sheet bundle may remain in the stack tray 54. In this case, the remaining sheet bundle after the staple processing in the stack tray 54 may hinder the operation of the pair of aligning unit 61, and the driving unit 63 for driving the pair of aligning unit 61 may break down.

In contrast, in the image forming apparatus 10 according to the embodiment of the present disclosure, as described below, the occurrence of malfunction caused by discharge failure of the sheet bundle after the staple processing can be avoided.

Specifically, the ROM 8B of the control unit 8 stores in advance an operation control program for causing the CPU 8A of the control unit 8 to execute the operation control process (as refer to the flowchart of FIG. 6) as described later. In addition, the operation control program may be recorded on a computer-readable recording medium such as a CD, DVD, or flash memory, be read from the recording medium, and be installed in a non-volatile storage device provided in the image forming apparatus 10.

Then, as shown in FIG. 5, the control unit 8 includes a detection processing unit 81, a stop processing unit 82, and a notification processing unit 83. Specifically, the control unit 8 uses the CPU 8A to execute the operation control program stored in the ROM 8B. As a result, the control unit 8 functions as a detection processing unit 81, a stop processing unit 82, and a notification processing unit 83. Here, the configuration including the post-processing apparatus 5 and the control unit 8 is an example of the post-processing apparatus in the present disclosure.

The detection processing unit 81 detects the failure of discharging the sheet bundle after the staple processing by the discharging roller 56.

For example, the detection processing unit 81 detects the discharge failure by using the sheet sensor 62. Specifically, the detection processing unit 81 detects the discharge failure if the sheet sensor 62 detects the sheet remaining on the stack tray 54 after the sheet bundle is discharged by the discharge roller 56.

In addition, the detection processing unit 81 may detect the discharge failure based on the current flowing through the drive unit 63. Specifically, when driving the first pair of aligning units 61 after the discharge roller 56 discharges the sheet bundle, and if the current flowing through the drive unit 63 exceeds a preset permissible value, the detection processing unit 81 may detect discharge failure. Note that the permissible value can be determined based on the current flowing through the drive unit 63 when the pair of aligning units 61 are driven in the state of the discharge failure.

The stop processing unit 82 can stop the transfer of the sheet from the sheet cassette 411 together with the operation of the pair of aligning units 61 when the discharge failure is detected by the detection processing unit 81. In other words, the stop processing unit 82 can stop the specific printing process when the discharge failure is detected by the detection processing unit 81.

Specifically, the stop processing unit 82 stops the operation of the pair of aligning units 61 and the transfer of the sheets from the sheet cassette 411 when the weight of the sheet bundle, which is failed to be discharged, exceeds a predetermined reference value. On the other hand, the stop processing unit 82 does not stop the operation of the pair of aligning units 61 and the transfer of the sheets from the sheet cassette 411 when the weight of the sheet bundle, which is failed to be discharged, is equal to or less than the reference value. The weight of the sheet bundle can be calculated based on the number of sheets loaded on the stack tray 54 and the weight per sheet registered in advance in the image forming apparatus 10. Further, the reference value can be set within the range of the weight of the sheet bundle that does not cause malfunction in the drive unit 63 based on the result of the experiment. In this experiment, the relationship between the weight of the sheet bundle, which is failed to be discharged, and the presence or absence of malfunction in the drive unit 63 when the pair of aligning unit 61 are driven in the state of the discharge failure is investigated.

In addition, the stop processing unit 82 may stop the operation of the pair of aligning units 61 and the transfer of the sheets from the sheet cassette 411 regardless of the weight of the sheet bundle that has failed to be discharged. Further, the stop processing unit 82 may be able to stop only the operation of the pair of aligning units 61 when the discharge failure is detected by the detection processing unit 81.

The notification processing unit 83 notifies the discharge failure when the detection processing unit 81 detects the discharge failure. For example, the notification processing unit 83 displays a notification screen indicating that a jam has occurred and that the jam has occurred in the stack tray 54 on the operation display unit 7, and it notifies that the detection failure has been detected. In addition, the notification processing unit 83 may notify that the discharge failure has been detected by turning on the warning lamp provided in the post-processing apparatus 5.

In addition, the control unit 8 does not have to include the notification processing unit 83.

[Operation Control Process]

Figure 6:
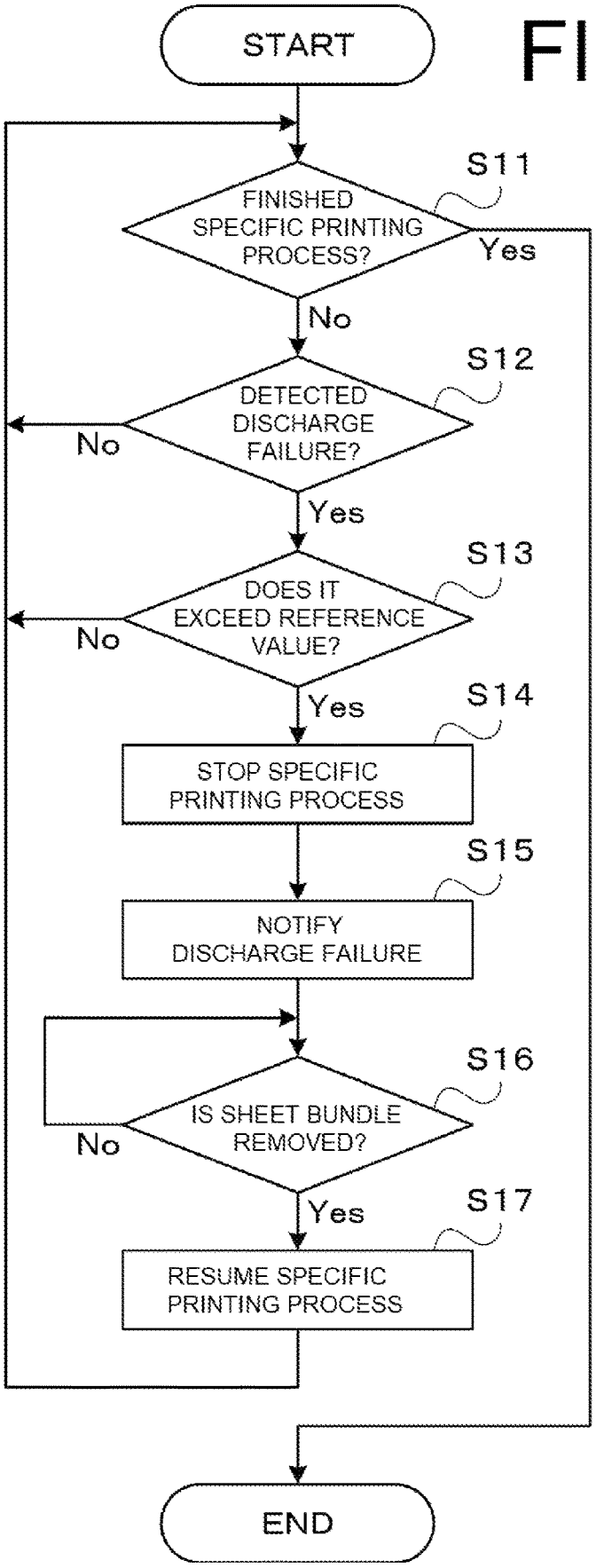
FIG. 6 is a flowchart showing an example of motion control processing executed by the image forming apparatus according to the embodiment of the present disclosure.

Hereinafter, an example of the procedure of the operation control process executed by the control unit 8 in the image forming apparatus 10 is described with reference to FIG. 6. Here, steps S11, S12, . . . represent the number of the processing procedure (step) executed by the control unit 8. In addition, the operation control process is executed together with the specific print process when the execution instruction of the specific print process is input.

<Step S11>

First, in step S11, the control unit 8 determines whether or not the specific printing process has been completed.

Here, when the control unit 8 determines that the specific printing process has been completed (Yes side of S11), the control unit 8 ends the operation control process. Otherwise, if the specific printing process has not been completed (No side of S11), the control unit 8 progresses the process to step S12.

<Step S12>

In step S12, the control unit 8 determines whether or not the discharge failure has been detected. Here, the process of step S12 is executed by the detection processing unit 81 of the control unit 8.

Here, when the control unit 8 determines that the discharge failure has been detected (Yes side of S12), the control unit 8 progresses the process to step S13. Further, if the discharge failure is not detected (No side of S12), the control unit 8 progresses the process to step S11.

<Step S13>

In step S13, the control unit 8 determines whether or not the weight of the sheet bundle, which is failed to be discharged, exceeds the reference value.

Here, if the control unit 8 determines that the weight of the sheet bundle, which is failed to be discharged, exceeds the reference value (Yes side of S13), the control unit 8 progresses the process to step S14. Further, if the weight of the sheet bundle, which is failed to be discharged, does not exceed the reference value (No side of S13), the control unit 8 progresses the process to step S11. As a result, it is possible to avoid stopping the specific printing process even if the drive unit 63 does not break down or has low possibility to break down.

<Step S14>

In step S14, the control unit 8 stops the specific printing process. Here, the processes of steps S13 and S14 are executed by the stop processing unit 82 of the control unit 8.

<Step S15>

In step S15, the control unit 8 notifies that the discharge failure has been detected. Specifically, the control unit causes the operation display unit 7 to display the notification screen. Here, the process of step S15 is executed by the notification processing unit 83 of the control unit 8.

<Step S16>

In step S16, the control unit 8 determines whether or not the sheet bundle has been removed. For example, the control unit 8 detects the removal of the sheet bundle by using the sheet sensor 62. Further, the control unit 8 may determine that the sheet bundle has been removed if a preset operation is performed on the notification screen.

Here, if the control unit 8 determines that the sheet bundle has been removed (Yes side of S16), the control unit 8 progresses the process to step S17. If the sheet bundle has not been removed (No side of S16), the control unit 8 waits for the sheet bundle to be removed in step S16.

<Step S17>

In step S17, the control unit 8 restarts the specific printing process.

As described above, in the image forming apparatus 10, when the discharge failure is detected in the stack tray 54, the specific printing process is stopped. As a result, it is possible to avoid the occurrence of malfunction due to the failure to discharge the sheet bundle after the staple processing.

By the way, in the typical technology, the discharge of the sheet bundle by the discharge unit may fail, and the sheet bundle may remain in the sheet loading unit. In this case, the bundle of sheets remaining in the sheet loading unit may hinder the operation of the aligning unit, and a driving unit such as a motor for driving the aligning unit may break down.

According to the present disclosure, a post-processing apparatus, an image forming apparatus, and a post-processing method capable of avoiding the occurrence of malfunction due to a failure to discharge the sheet bundle after the binding processing can be attained.

In addition, the image forming unit 3 may form an image by an image forming method different from the electrophotographic method such as an inkjet method.

Further, instead of the staple unit 55, the post-processing apparatus 5 may include a post-processing unit that executes a binding process different from the staple processing on the sheet bundle loaded on the stack tray 54.

What is claimed is:

1. A post-processing apparatus comprising:

a sheet loading unit on which a plurality of sheets transported from a sheet feed unit are loaded;

a binding processing unit that binds the plurality of sheets loaded on the sheet loading unit;

a discharge unit that discharges a sheet bundle bound by the binding processing unit from the sheet loading unit;

an aligning unit that performs an aligning operation that moves on the sheet loading unit between a first position contacting a sheet loaded on the sheet loading unit and a second position separating from the sheet each time a sheet or a plurality of sheets are conveyed to the sheet loading unit;

a detection processing unit that detects a discharge failure of the sheet bundle by the discharge unit; and a stop processing unit that is capable of stopping the aligning operation of the aligning unit when the discharge failure is detected by the detection processing unit.

2. The post-processing apparatus according to claim 1, wherein the aligning unit moves in the width direction orthogonal to a discharge direction of the sheet bundle by the discharge unit in the sheet loading unit.

3. The post-processing apparatus according to claim 1, further comprising a sheet sensor that is capable of detecting the discharge of a sheet from the sheet loading unit, wherein the detection processing unit detects the discharge failure by using the sheet sensor.

4. The post-processing apparatus according to claim 1, further comprising a drive unit that moves the aligning unit by supply of electric current, and the detection processing unit detects the discharge failure based on the current flowing through the drive unit.

5. The post-processing apparatus according to claim 1, further comprising a notification processing unit that notifies the discharge failure when the detection processing unit detects the discharge failure.

6. The post-processing apparatus according to claim 1, wherein the stop processing unit is capable of stopping the transfer of sheets from the sheet feed unit together with the aligning operation when the discharge failure is detected by the detection processing unit.

7. The post-processing apparatus according to claim 6, wherein the stop processing unit performs said stopping of the transfer of sheets together with the aligning operation when weight of the sheet bundle exceeds a predetermined reference value, and does not perform said stopping of the transfer of sheets together with the aligning operation when weight of the sheet bundle is less than the predetermined reference value.

8. An image forming apparatus including:

the post-processing apparatus according to claim 1;

the sheet feed unit; and an image forming unit that forms an image on a sheet transported from the sheet feed unit to the sheet loading unit.

9. A post-processing method comprising steps of:

a loading process for loading a plurality of sheets transported from a sheet feed unit on a sheet loading unit, a binding process for binding the plurality of sheets loaded on the sheet loading unit;

a discharging process for discharging a sheet bundle bound by the binding process from the sheet loading unit;

an aligning process to adjust posture of the sheet bundle by moving between a first position contacting a sheet loaded on the sheet loading unit and a second position separating from the sheet each time one sheet or a plurality of sheets are conveyed to the sheet loading unit;

a detection process for detecting a discharge failure of the sheet bundle in the discharging process; and a stop process for stopping the aligning process when the discharge failure is detected.

* * * * *